US006174003B1

(12) United States Patent
Smart

(10) Patent No.: US 6,174,003 B1
(45) Date of Patent: Jan. 16, 2001

(54) FASTENING ASSEMBLY COMPRISING BOLT AND KEEPER

(76) Inventor: Jane Belinda Smart, 38 Arnside Court, North Park Road, Brookvale Village, Erdington, Birmingham B23 7YG (GB)

( * ) Notice: Under 35 U.S.C. 154(b), the term of this patent shall be extended for 0 days.

(21) Appl. No.: 09/314,335

(22) Filed: May 19, 1999

(51) Int. Cl.[7] ..... E05C 19/12; E05C 5/00

(52) U.S. Cl. ..... 292/109; 292/114; 292/6; 292/56

(58) Field of Search ..... 292/109, 114, 292/110, 117, 122, 5, 6, 8, 11, 56, 63

(56) References Cited

U.S. PATENT DOCUMENTS

| | | | | |
|---|---|---|---|---|
| 983,647 | * | 2/1911 | Romines | 292/110 |
| 2,783,071 | * | 2/1957 | Williams | 292/109 |
| 3,360,290 | * | 12/1967 | De Gray | 292/6 |
| 3,515,421 | * | 6/1970 | Poe et al. | 292/11 |
| 4,312,527 | | 1/1982 | Tannery | 292/49 |
| 4,482,175 | * | 11/1984 | Sugie | 292/45 |
| 4,512,597 | | 4/1985 | Nabb et al. | 292/143 |
| 5,544,924 | * | 8/1996 | Paster | 292/6 |

FOREIGN PATENT DOCUMENTS

| | | | | |
|---|---|---|---|---|
| 1046541 | | 10/1966 | (GB) . | |
| 1 422 321 | | 1/1976 | (GB) . | |
| 1 505 455 | | 3/1978 | (GB) . | |
| 2 134 960 | | 8/1984 | (GB) . | |
| 2275500 | * | 8/1994 | (GB) | 292/11 |

* cited by examiner

*Primary Examiner*—Lynne H. Browne
*Assistant Examiner*—John B. Walsh
(74) *Attorney, Agent, or Firm*—Kirschstein, et al.

(57) ABSTRACT

A fastening assembly includes a bolt; a support for the bolt, the bolt being movable relative to the support between an extended position and a retracted position; and a keeper with which the bolt is engageable when in its extended position. The keeper comprises a keeper element and the bolt affords a formation able to receive and retain the keeper element. The bolt comprises portions movable relative to one another to permit the keeper element to enter the formation as the bolt is moved from its retracted to its extended position. Relative movement between the bolt portions is prevented when the bolt is in its extended position, whereby the keeper element is held retained in the formation.

8 Claims, 1 Drawing Sheet

FASTENING ASSEMBLY COMPRISING BOLT AND KEEPER

DESCRIPTION OF THE INVENTION

BACKGROUND OF THE INVENTION

1. Field of the Invention

This invention relates to a fastening assembly comprising a bolt and a keeper with which the bolt is engageable, for fastening doors or windows.

2. Description of Prior Art

Fastening assemblies each comprising a bolt and a keeper are well known for fastening doors or windows, and there are many different types of such fastening assembly. What such types have in common is a bolt carried by a Support means and movable relative thereto between an extended position in which the bolt is able to engage with the keeper and a retracted position in which it is not able to engage the keeper. Usually, support means for the bolt is mounted on an openable panel of the door or window and the keeper on the fixed frame relative to which the panel is openable. In its simplest form, the bolt is able to be directly manually, moved between its extended and retracted positions, but in more complex forms there are many different types of mechanism by which the bolt is movable. The bolt may form part of a lock, i.e. be movable between its extended and retracted positions by use directly or indirectly of a key.

A bolt for a pivotally openable window or door is usually provided at an edge of the window or door remote from the hinge or hinges by which the window or door is mounted relative to its fixed frame, the bolt being movable in a direction parallel or substantially parallel to the general plane of the window or door, to protrude beyond such edge of the window or door when it is in its extended position, thereby to be engageable with the keeper which is provided on or in the fixed frame. In some cases, however, it might be possible by application of force to effect relative movement between the window or door and fixed frame in the direction of retraction of the bolt, thereby to disengage the bolt from the keeper and permit the window or door to be opened without extraction of the bolt. There are fastening assemblies which aim to defeat the opening of a fastened window or door in this manner, but with the drawback of greater complexity, e.g. by requiring a bolt mounted to its support means in a manner enabling it to be moved in an arcuate path of movement.

Various forms of fastening assembly offering improved security are disclosed for example in the following references:

GB-2134960 discloses a locking device with a latch bolt engageable by a retaining element, in order to prevent the bolt from being forced back from its locking position. GB-1505455 discloses a sliding bolt fastening device for a vehicle panel or tailboard, with a toggle mechanism arranged to provide a self-tightening effect. GB-1422321 discloses a bolt which is lockable against axial releasing movement from its keep, by means of a plug which extends into the bolt and operates a detent mechanism. GB-1046541 discloses a lock whose bolt also includes an axial slider. After the bolt head has passed through a slot in the striker, the slider enters the slot to prevent withdrawal of the bolt from the slot. U.S. Pat. No. 4,512,597 discloses a lock whose bolt has auxiliary locking elements movable outwardly by a central plunger. U.S. Pat. No. 4,312,527 discloses a locking mechanism which utilises spaced plates with T-shaped tongues, between which bolt members are movable.

SUMMARY OF THE INVENTION

It is broadly the object of the present invention to provide a fastening assembly which provides enhanced security, but with such drawbacks reduced or minimized.

According to the invention I provide a fastening assembly, comprising a bolt; a support means for the bolt, the bolt being movable relative to the support means between an extended position and a retracted position; and a keeper means with which the bolt is engageable when in its extended position, wherein the keeper means comprises a keeper element and the bolt affords a formation able to receive and retain the keeper element, the bolt comprising portions moveable relative to one another to permit the keeper element to enter said formation as the bolt is moved from its retracted to its extended position, and there being means for preventing relative movement between said portions when the bolt is in its extended position, whereby the keeper element is held retained in said formation.

In a fastening assembly according to the invention, the entry of the keeper element into the formation afforded by the bolt as the latter is moved from its retracted position to its extended position, and then the retention of the keeper element in the formation in the bolt when the bolt is in its extended position has the result that the bolt cannot be disengaged from the keeper means by moving the bolt and its support means relative to the keeper means, unless the bolt has been moved from its extended position. Preferably said formation afforded by the bolt comprises an aperture extending transversely of the bolt. In this case, the keeper element preferably comprises an element extending transversely of the keeper means, for reception in said aperture.

The keeper means may comprise a plate having an aperture for receiving the bolt, the plate being adapted to be fixed to a door or window frame to lie in a plane perpendicular to the direction in which the bolt moves between its extended and retracted positions to enter and withdraw from the aperture, and the keeper element may then be spaced rearwardly of the plate. The keeper element preferably is in the form of a peg or pin.

The bolt conveniently comprises two jaw portions together defining said formation for receiving the keeper element, said jaw portions being movable away from one another to permit the keeper element to enter the formation, and preferably being spring-biased towards one another.

Preferably the jaw portions have cam surfaces which, by engagement with the keeper element, urge the jaw portions of the bolt apart to permit the keeper element to enter or leave the formation, as the case may be, in the course of movement of the bolt between its retracted and extended positions.

The jaw portions may have formations which co-operate with abutment formations provided on the support means for the bolt as the latter approaches its extended position, to prevent the jaw portions being moved apart.

The jaw portions of the bolt may respectively be pivotally mounted to a bolt member which carries them.

The bolt preferably is part of a lock which includes a key-operable mechanism for moving the bolt between its extended and retracted positions.

BRIEF DESCRIPTION OF DRAWINGS

The invention will now be described by way of example with reference to the accompanying drawings, of which.

DESCRIPTION OF PREFERRED EMBODIMENT

Figure 1:
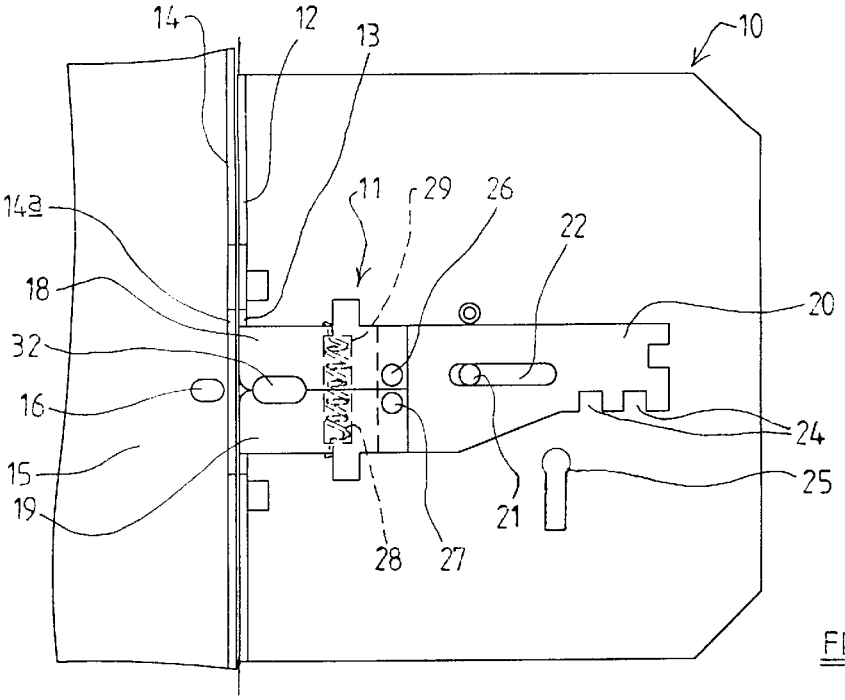
FIG. 1 is a view of a fastening assembly in accordance with the invention, in a first operative position.

Referring to the drawings, there is shown a lock casing indicated generally at 10 which includes a bolt assembly indicated generally at 11. The lock casing comprises a generally enclosed body which preferably is adapted to be mounted within the thickness of a door, and has a front plate 12 which when the lock is thus installed as a mortice lock is intended to lie flush with the edge of the door. The bolt assembly is supported for reciprocatoly movement relative to the casing 10, being shown in FIG. 1 in a fully retracted position and in FIG. 3 in a fully extended position, the bolt assembly emerging from an aperture 13 in the front plate 12.

A keeper assembly is adapted to be secured to the fixed frame surrounding the door facing the lock when the door is in its closed position. The keeper assembly comprises a front plate 14 with an aperture 14*a* which can be entered by the bolt assembly, and a housing pall 15 extending rearwardly from the front plate 14. A keeper element in the form of a pin or peg 16 is disposed behind the aperture 14*a* in the front plate 14 of the keeper assembly, such keeper element extending transversely of the housing part 15 thereof. The cross-sectional shape of the keeper element 16 is circular, having flattened opposed upper and lower surfaces.

The bolt assembly 11 comprises two jaw portions 18, 19 carried by a slider member 20. The slider member is guided for linear sliding movement relative to the lock casing 10 by a stump 21 extending through a slot 22 in the slider member 20. It will be noted that the slider 20 has recesses 24 for engagement by a key inserted into the lock casing (a keyhole being indicated at 25) for moving the slider in opposite directions. It will be appreciated that the lock mechanism will normally include levers and/or other provisions for security, such as characteristically are to be found in locks.

The jaw portions 18, 19 are pivotally secured to the slider plate 20 by respective pivot pins 26, 27. Such pivotal mountings enable the jaw portions to move away from one another as shown in FIG. 2. The jaw portions are spring-biased towards one another, to meet as shown in FIGS. 1 and 3, by a tension spring 28 which is disposed in facing recesses 29 in the jaw portions.

Figure 2:
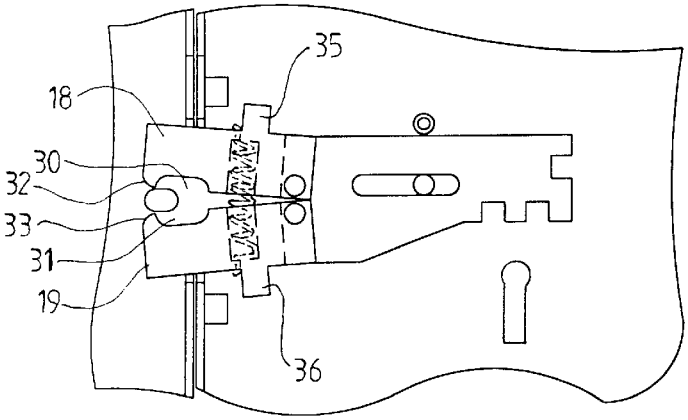
FIGS. 2 and 3 are views of the assembly of FIG. 1, in further operative positions.
Figure 3:
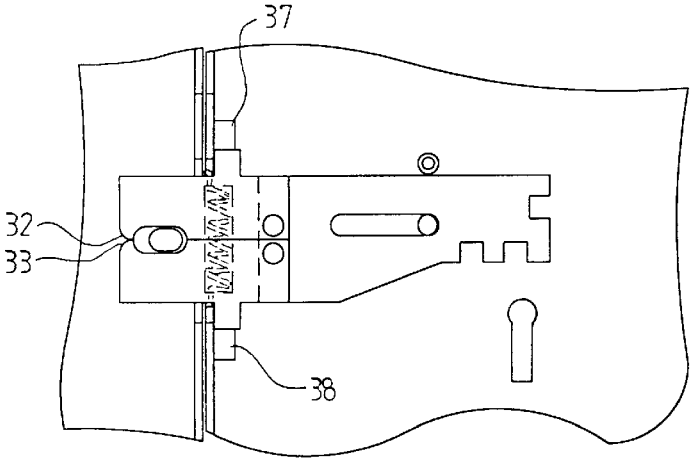

The two jaw portions 18, 19 have respective facing recess portions 30, 31 which when the jaw portions are in their positions as shown in FIGS. 1 and 3 define an aperture 32 extending transversely of the bolt assembly. The dimensions of the aperture 32 are sufficient to receive the keeper element 16 and to permit some reciprocatory movement of the bolt assembly when the keeper element 16 is thus received. The jaw portions 18, 19 have at their adjacent forward ends curved cam surfaces 32, 33 respectively, shaped so that when the keeper element 16 is encountered as the bolt assembly is moved to its extended position the jaw portions are moved apart to permit the keeper element to enter the aperture 32. This is shown in FIG. 2. The adjacent end boundaries of the recesses 30, 31 which define the aperture 32 are also of curved configuration, so that as the bolt assembly is moved from its extended position to its retracted position, contact of the jaw portions with the keeper element 16 will urge them apart to permit such movement of the bolt assembly.

The jaw portions 18, 19 have respective formations 35, 36 extending in opposite directions therefrom, adjacent the pivot pins 26, 27. The front plate 12 of the lock casing has abutments 37, 38, arranged so that in a final part of the movement of the bolt assembly to its fully extended position the formations 35, 36 slide between the abutments 37, 38. When this position has been reached, as shown in FIG. 3, the jaw portions are unable to be moved apart from one another to release the pin or peg 16 from the aperture 32.

Thus, disengagement of the bolt assembly of the lock from the keeper thereof, by movement of the door carrying the lock away from the fixed frame in the direction of retraction of the bolt assembly of the lock, is not possible. Thus, security is enhanced. Other than by use of excessive force such as to cause breakage of the door or its fixed frame, release of the door from its locked position relative to its fixed frame requires the use of a key to retract the bolt assembly of the lock.

A conventional lock may be modified to become a lock in accordance with the invention in a relatively straightforward manner, by substitution of the particular form of bolt assembly above described for the conventional bolt assembly, and by the addition of the keeper element to the keeper assembly of the lock. Such modifications do not require fundamental re-design of the lock, and thus are relatively inexpensive to provide.

The features disclosed in the foregoing description, or the accompanying drawing, expressed in their specific forms or in terms of a means for performing the disclosed function, or a method or process for attaining the disclosed result, may, separately or in any combination of such features, be utilized for realizing the invention in diverse forms thereof.

What is claimed is:

1. A fastening assembly, comprising:

a) a bolt having two jaw portions together defining a transverse aperture;

b) support means for supporting the bolt for movement relative to the support means, in a line of movement, between a retracted position and an extended position;

c) keeper means with which the bolt is engageable as the bolt approaches and when the bolt is in said extended position, said keeper means including a transversely extending keeper element receivable in said transverse aperture, said keeper means including a plate having a plate aperture for receiving the bolt, the plate being adapted to be fixed to a door or window frame to lie in a plane transverse to the direction in which the bolt moves between said extended and retracted positions to enter and withdraw from the plate aperture;

d) means for supporting said two jaw portions in relation to said bolt for movement apart relative to one another transversely of said line of movement and said keeper element, for permitting the keeper element to pass between said jaw portions and to enter said transverse aperture, in the course of movement of the bolt from said retracted to said extended position; and e) means engageable by said jaw portions as said bolt approaches said extended position and when said bolt is in said extended position, for preventing said movement apart of said jaw portions.

2. At A fastening assembly according to claim 1 wherein said keeper element comprises a pin member.

3. A fastening assembly according to claim 1 wherein said keeper element is spaced rearwardly of said plate.

4. A fastening assembly according to claim 1 wherein said jaw portions are spring biased towards one another.

5. A fastening assembly according to claim 1 wherein said jaw portions have cam surfaces which, by engagement with the keeper element, urge the jaw portions of the bolt apart from one another to permit the keeper element to enter or leave in the course of movement of the bolt between said retracted and extended positions.

6. A fastening assembly according to claim 1 wherein said jaw portions have formations which cooperate with abutment formations provided on the support means for the bolt, as the bolt approaches said extended position, to prevent said jaw portions from being moved apart from one another.

7. A fastening assembly according to claim 1 wherein said jaw portions of the bolt are respectively pivotally mounted to a bolt member which carries them.

8. A fastening assembly according to claim 1 further comprising a key-operable mechanism for moving the bolt between said extended and retracted positions.

* * * * *